US010565932B2

(12) United States Patent
Zhang

(10) Patent No.: US 10,565,932 B2
(45) Date of Patent: Feb. 18, 2020

(54) PIXEL CIRCUIT, DISPLAY PANEL, AND DRIVING METHOD

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventor: Yi Zhang, Beijing (CN)

(73) Assignees: BOE TECHNOLOGY GROUP CO., LTD., Beijing (CN); ORDOS YUANSHENG OPTOELECTRONICS CO., LTD., Ordos (CN)

( * ) Notice: Subject to any disclaimer, the term of this patent is extended or adjusted under 35 U.S.C. 154(b) by 0 days.

(21) Appl. No.: 15/764,995

(22) PCT Filed: Dec. 5, 2017

(86) PCT No.: PCT/CN2017/114545
§ 371 (c)(1),
(2) Date: Mar. 30, 2018

(87) PCT Pub. No.: WO2018/166245
PCT Pub. Date: Sep. 20, 2018

(65) Prior Publication Data

US 2019/0043426 A1 Feb. 7, 2019

(30) Foreign Application Priority Data

Mar. 17, 2017 (CN) ..... 2017 1 0161047

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2310/0264* (2013.01)

(58) Field of Classification Search
CPC ... G09G 3/3258; G09G 3/3225; G09G 3/3233
(Continued)

(56) References Cited

U.S. PATENT DOCUMENTS

2007/0273618 A1 11/2007 Hsieh et al.
2008/0169754 A1* 7/2008 Yang ..... G09G 3/3233 313/504

(Continued)

FOREIGN PATENT DOCUMENTS

CN 101079234 A 11/2007
CN 102446489 A 5/2012

(Continued)

OTHER PUBLICATIONS

Office Action dated Mar. 19, 2019, issued in counterpart CN Application No. 201710161047.X, with English translation (14 pages).

(Continued)

*Primary Examiner* — Prabodh M Dharia
(74) *Attorney, Agent, or Firm* — Westerman, Hattori, Daniels & Adrian, LLP

(57) ABSTRACT

A pixel circuit includes a driving sub-circuit, a compensation sub-circuit, a data writing sub-circuit, and a data voltage storage sub-circuit. The driving sub-circuit includes a first electrode electrically coupled to a high voltage input terminal and a second electrode configured to output a driving current. The compensation sub-circuit is configured to store a threshold voltage of the driving sub-circuit. The compensation sub-circuit includes a first terminal electrically coupled to the second electrode of the driving sub-circuit, a second terminal electrically coupled to a gate electrode of (Continued)

the driving sub-circuit, a third terminal, and a fourth terminal, and a control terminal. The data writing sub-circuit includes a first terminal and a second terminal. The data voltage storage sub-circuit includes a first terminal electrically coupled to the third terminal of the compensation sub-circuit and the second terminal of the data writing sub-circuit; and a second terminal.

18 Claims, 6 Drawing Sheets

(58) Field of Classification Search
USPC ..... 345/82, 205, 212, 504, 760
See application file for complete search history.

(56) References Cited

U.S. PATENT DOCUMENTS

| | | | | |
|---|---|---|---|---|
| 2010/0127955 | A1 | 5/2010 | Choi | |
| 2010/0156762 | A1 | 6/2010 | Choi | |
| 2011/0025659 | A1* | 2/2011 | Kwak | G09G 3/3233 345/205 |
| 2012/0306842 | A1* | 12/2012 | Miyazawa | G09G 3/3466 345/212 |
| 2014/0145917 | A1* | 5/2014 | Kwak | G09G 3/3233 345/82 |
| 2017/0018229 | A1* | 1/2017 | Zhang | G09G 3/3233 |
| 2017/0116918 | A1* | 4/2017 | Dong | G09G 3/3233 |
| 2017/0116919 | A1* | 4/2017 | Ma | G02F 1/136213 |
| 2017/0243542 | A1* | 8/2017 | Xiang | G09G 3/3291 |
| 2017/0249898 | A1* | 8/2017 | Ma | G09G 3/3233 |
| 2017/0270859 | A1* | 9/2017 | Li | G09G 3/3233 |
| 2017/0270860 | A1* | 9/2017 | Wang | G09G 3/3233 |
| 2018/0033365 | A1* | 2/2018 | Zhang | G09G 3/3233 |
| 2018/0053642 | A1* | 2/2018 | Jo | H01J 49/0418 |
| 2019/0114960 | A1* | 4/2019 | Lee | G09G 3/3225 |

FOREIGN PATENT DOCUMENTS

| | | | | |
|---|---|---|---|---|
| CN | 102629447 | A | 8/2012 | |
| CN | 103700342 | A | 4/2014 | |
| CN | 105185306 | * | 9/2015 | G09G 3/3233 |
| CN | 105185306 | A | 12/2015 | |
| CN | 106409227 | A | 2/2017 | |
| KR | 10-2007-0015825 | A | 2/2007 | |
| KR | 10-2015-0138527 | A | 12/2015 | |

OTHER PUBLICATIONS

English translation of International Search Report dated Dec. 29, 2017, issued in counterpart International Application No. PCT/CN2017/114545 (11 pages).

Office Action dated May 17, 2019, issued in counterpart KR Application No. 10-2018-7011763, with English translation. (11 pages).

Office Action dated Nov. 27, 2019, issued in counterpart KR Application No. 10-2018-7011763, with English translation. (11 pages).

* cited by examiner

PIXEL CIRCUIT, DISPLAY PANEL, AND DRIVING METHOD

CROSS-REFERENCE TO RELATED APPLICATION

This PCT patent application claims priority to Chinese Patent Application No. 201710161047.X, filed on Mar. 17, 2017, the entire contents of which are incorporated herein by reference.

TECHNICAL FIELD

The present disclosure generally relates to the field of display devices and, more particularly, to a pixel circuit, a display panel, and a driving method.

BACKGROUND

Light-emitting diode (LED) display devices have broad applications in the display field. Generally, LED display devices are fabricated by using a low-temperature polysilicon process. Due to process non-uniformity, LED display devices may have non-uniform threshold voltages for driving transistors in pixel units, resulting in a non-uniform display.

SUMMARY

In one aspect, the present disclosure provides a pixel circuit. The pixel circuit includes a driving sub-circuit, a compensation sub-circuit, a data writing sub-circuit, and a data voltage storage sub-circuit. The driving sub-circuit includes a first electrode electrically coupled to a high voltage input terminal and a second electrode configured to output a driving current. The compensation sub-circuit includes a first terminal electrically coupled to the second electrode of the driving sub-circuit, a second terminal electrically coupled to a gate electrode of the driving sub-circuit, a third terminal, a fourth terminal electrically coupled to a fixed voltage terminal, and a control terminal. The compensation sub-circuit is configured to store a threshold voltage of the driving sub-circuit, and in response to a compensation control signal received at the control terminal, electrically link the fourth terminal of the compensation sub-circuit to the third terminal of the compensation sub-circuit and electrically link the first terminal of the compensation sub-circuit to the second terminal of the compensation sub-circuit. The data writing sub-circuit includes a first terminal, a second terminal, and a control terminal. The data writing sub-circuit is configured to, in response to a data writing control signal received at the control terminal of the data writing sub-circuit, electrically link the first terminal of the data writing sub-circuit to the second terminal of the data writing sub-circuit. The data voltage storage sub-circuit is configured to store a data voltage inputted through the data writing sub-circuit. The data voltage storage sub-circuit includes a first terminal electrically coupled to the third terminal of the compensation sub-circuit and the second terminal of the data writing sub-circuit and a second terminal electrically coupled to the high voltage input terminal.

In some embodiments, the data voltage storage sub-circuit includes a data voltage storage capacitor. The second terminal of the data voltage storage sub-circuit includes a first electrode plate of the data voltage storage capacitor. The first terminal of the data voltage storage sub-circuit includes a second electrode of the data voltage storage capacitor.

In some embodiments, the compensation sub-circuit includes a compensation capacitor, a first compensation transistor, and a second compensation transistor. The compensation capacitor includes a first electrode plate and a second electrode plate. The first compensation transistor includes a first electrode, a second electrode electrically coupled to the first electrode plate of the compensation capacitor, and a gate electrode. The second compensation transistor includes a first electrode, a second electrode, and a gate electrode electrically coupled to the gate electrode of the first compensation transistor. The first terminal of the compensation sub-circuit includes the second electrode of the second compensation transistor. The second terminal of the compensation sub-circuit includes the second electrode plate of the compensation capacitor and the first electrode of the second compensation transistor. The third terminal of the compensation sub-circuit includes the first electrode plate of the compensation capacitor. The fourth terminal of the compensation sub-circuit includes the first electrode of the first compensation transistor. The control terminal of the compensation sub-circuit includes the gate electrode of the first compensation transistor.

In some embodiments, the data writing sub-circuit includes a data writing transistor. The first terminal of the data writing sub-circuit includes a first electrode of the data writing transistor electrically coupled to a data signal input terminal. The second terminal of the data writing sub-circuit includes a second electrode of the data writing transistor. The control terminal of the data writing sub-circuit includes a gate electrode of the data writing transistor.

In some embodiments, the pixel circuit further include a light-emitting sub-circuit coupled to the second electrode of the driving sub-circuit and configured to emit light in response to the driving current.

In some embodiments, the pixel circuit further includes a light emission control sub-circuit. The light emission control sub-circuit includes a first terminal electrically coupled to the second electrode of the driving sub-circuit, a second terminal electrically coupled to a first terminal of the light-emitting sub-circuit, and a control terminal. The light emission control sub-circuit is configured to, in response to a light emission control signal received at the control terminal of the light emission control sub-circuit, electrically link the second electrode of the driving sub-circuit to the first terminal of the light-emitting sub-circuit.

In some embodiments, the light emission control sub-circuit includes a light emission control transistor. The first terminal of the light emission control sub-circuit includes a first electrode of the light emission control transistor. The second terminal of the light emission control sub-circuit includes a second electrode of the light emission control transistor. The control terminal of the light emission control sub-circuit includes a gate electrode of the light emission control transistor.

In some embodiments, the pixel circuit further includes a discharge sub-circuit. The discharge sub-circuit includes a first terminal electrically coupled to a reference voltage input terminal, a second terminal electrically coupled to a first terminal of the light-emitting sub-circuit, and a control terminal. The discharge sub-circuit is configured to, in response to a discharge control signal received at the control terminal of the discharge sub-circuit, electrically link the first terminal of the discharge sub-circuit to the second terminal of the discharge sub-circuit. The control terminal of the discharge sub-circuit is electrically coupled to the control terminal of the compensation sub-circuit.

In some embodiments, the discharge sub-circuit includes a discharge transistor. The first terminal of the discharge sub-circuit includes a first electrode of the discharge transistor. The second terminal of the discharge sub-circuit includes a second electrode of the discharge transistor. The control terminal of the discharge sub-circuit includes a gate electrode of the discharge transistor.

In some embodiments, the pixel circuit further includes an initialization sub-circuit. The initialization sub-circuit includes a first terminal electrically coupled to the fixed voltage terminal, a second terminal electrically coupled to the third terminal of the compensation sub-circuit, a third terminal electrically coupled to the second terminal of the compensation sub-circuit, a fourth terminal electrically coupled to a reference voltage input terminal, and a control terminal. The initialization sub-circuit is configured to, in response to an initialization control signal received at the control terminal of the initialization sub-circuit, electrically link the second terminal of the initialization sub-circuit to the first terminal of the initialization sub-circuit and electrically link the third terminal of the initialization sub-circuit to the fourth terminal of the initialization sub-circuit.

In some embodiments, the initialization sub-circuit includes a first initialization transistor and a second initialization transistor. The fourth terminal of the initialization sub-circuit includes a first electrode of the first initialization transistor. The third terminal of the initialization sub-circuit includes a second electrode of the first initialization transistor. The control terminal of the initialization sub-circuit includes a gate electrode of the first initialization transistor. The first terminal of the initialization sub-circuit includes a first electrode of the second initialization transistor. The second terminal of the initialization sub-circuit includes a second electrode of the second initialization transistor. A gate electrode of the second initialization transistor is electrically coupled to the gate electrode of the first initialization transistor.

In some embodiments, the fixed voltage terminal includes a reference voltage input terminal.

In some embodiments, the fixed voltage terminal includes the high voltage input terminal.

Another aspect of the present disclosure provides a display panel. The display panel includes a plurality of pixel units, a plurality of data lines, and a plurality of sets of gate lines. The plurality of pixel units each includes a pixel circuit. The plurality of data lines are electrically coupled to data signal input terminals. Each one of the sets of gate lines is coupled to the pixel circuit of one of the pixel units and includes a compensation control gate line, a data writing control gate line, and an initialization control gate line. The compensation control gate line is electrically coupled to the control terminal of the compensation sub-circuit of the pixel circuit. The data writing control gate line is electrically coupled to the control terminal of the data writing sub-circuit of the pixel circuit. The initialization control gate line electrically coupled to a control terminal of an initialization sub-circuit of the pixel circuit.

In some embodiments, each one of the sets of gate lines further include a light emission control gate line electrically coupled to a control terminal of a light emission control sub-circuit of the pixel circuit.

Another aspect of the present disclosure provides a driving method for a display panel. The driving method includes, at a compensation phase of a duty cycle, providing a compensation control signal to the compensation control gate line; at a data writing phase of the duty cycle, providing a data writing control signal to the data writing control gate line and providing a data signal to the data line; and at a light emission phase, controlling a light-emitting sub-circuit of the pixel circuit to emit light by the driving current generated by the driving sub-circuit.

In some embodiments, the pixel circuit includes a light emission control sub-circuit. Each one of the sets of gate lines includes a light emission control gate line. A control terminal of the light emission control sub-circuit is electrically coupled to the light emission control gate line. The method further includes, at the light emission phase, providing a light emission control signal to the light emission control gate line.

In some embodiments, the driving method further includes, at an initialization phase of the duty cycle before the compensation phase, providing an initialization control signal to an initialization control gate line.

In some embodiments, a time interval is provided between at least two neighboring ones of the compensation phase, the data writing phase, and the light emission phase.

BRIEF DESCRIPTION OF THE FIGURES

The following drawings are merely examples for illustrative purposes according to various disclosed embodiments and are not intended to limit the scope of the present disclosure.

DETAILED DESCRIPTION

Exemplary embodiments of the disclosure will now be described in more detail with reference to the drawings. It is to be noted that, the following descriptions of some embodiments are presented herein for purposes of illustration and description only, and are not intended to be exhaustive or to limit the scope of the present disclosure.

The aspects and features of the present disclosure can be understood by those skilled in the art through the exemplary embodiments of the present disclosure further described in detail with reference to the accompanying drawings.

Figure 1:
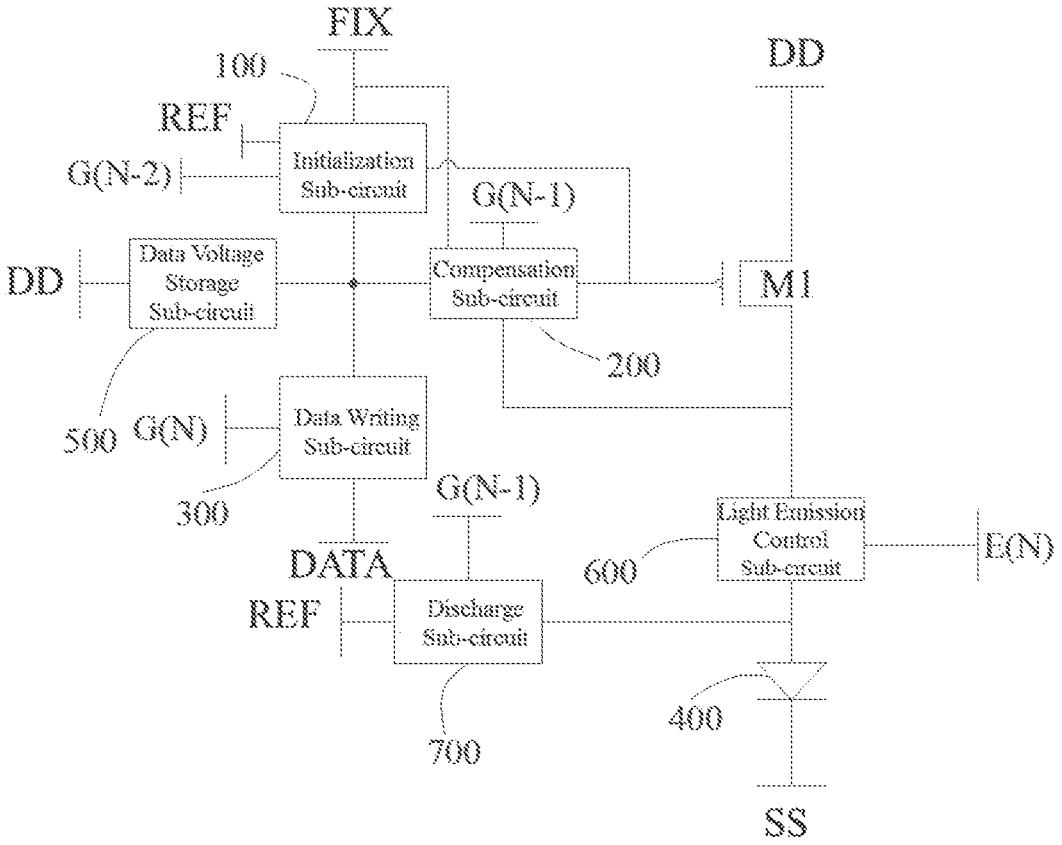
FIG. 1 illustrates a schematic view of an exemplary pixel circuit including exemplary sub-circuits according to various disclosed embodiments of the present disclosure.

The present disclosure provides a pixel circuit. FIG. 1 illustrates a schematic view of an exemplary pixel circuit including exemplary sub-circuits according to various disclosed embodiments of the present disclosure. As shown in FIG. 1, the exemplary pixel circuit includes an initialization sub-circuit 100, a driving sub-circuit M1, a compensation sub-circuit 200, a data writing sub-circuit 300, a light-emitting sub-circuit 400, and further a data voltage storage sub-circuit 500. Each of the sub-circuits described in this disclosure can include a circuit including one or more electronic components, such as one or more transistors. For example, as shown in FIG. 1, the driving sub-circuit includes a driving transistor. In the present disclosure, the driving sub-circuit may include one or more other suitable structures, and is not limited to the driving transistor shown in FIG. 1.

A first electrode of the driving sub-circuit M1 is electrically coupled to a high voltage input terminal DD, and a second electrode of the driving sub-circuit M1 is configured to output a driving current to cause the light-emitting sub-circuit 400 to emit light.

A first terminal of the compensation sub-circuit 200 is electrically coupled to the second electrode of the driving sub-circuit M1. A second terminal of the compensation sub-circuit 200 is electrically coupled to a gate electrode of the driving sub-circuit M1. A third terminal of the compensation sub-circuit 200 is electrically coupled to a first terminal of the data voltage storage sub-circuit 500. A fourth terminal of the compensation sub-circuit 200 is electrically coupled to a fixed voltage terminal FIX. In response to a compensation control signal received at a control terminal of the compensation sub-circuit 200, the first terminal of the compensation sub-circuit 200 may be electrically linked to the second terminal of the compensation sub-circuit 200, such that the second electrode and the gate electrode of the driving sub-circuit M1 may be electrically linked and a threshold voltage Vth of the driving sub-circuit M1 may be stored in the compensation sub-circuit 200. In addition, in response to the compensation control signal received at the control terminal of the compensation sub-circuit 200, the fourth terminal of the compensation sub-circuit 200 may be electrically linked to the third terminal of the compensation sub-circuit 200. Because the fourth terminal of the compensation sub-circuit 200 is electrically coupled to the fixed voltage terminal FIX, electrically linking the third terminal of the compensation sub-circuit 200 and the fourth terminal of the compensation sub-circuit 200 can cause a voltage at the third terminal of the compensation sub-circuit 200 to be held at a fixed voltage inputted from the fixed voltage terminal FIX.

Here, the term "electrically link," "electrically linking," "electrically linked," or the like refers to establishing an electrical signal path. Thus, a terminal, a node, a port, an electrode, or the like (collectively referred to as a "circuit point") being electrically linked to another circuit point refers to establishing an electrical signal path between the two circuit points such that a signal received at one circuit point can be transmitted to the other circuit point.

In response to the compensation control signal received at the control terminal of the compensation sub-circuit 200, two conductive paths may form in the compensation sub-circuit 200. A first conductive path may form between the first terminal of the compensation sub-circuit 200 and the second terminal of the compensation sub-circuit 200. A second conductive path may form between the third terminal of the compensation sub-circuit 200 and the fourth terminal of the compensation sub-circuit 200. No conductive coupling may exist between the two conductive paths.

In addition, in the present disclosure, the type of the compensation control signal may be selected according to the type of transistors, such as thin film transistors, in the compensation sub-circuit 200. For example, if the transistors in the compensation sub-circuit 200 are P-type transistors, the compensation control signal may be a low level signal. If the transistors in the compensation sub-circuit 200 are an N-type transistors, the compensation control signal may be a high level signal. If the control terminal of the compensation sub-circuit 200 does not receive the compensation control signal or receives a signal different from the compensation control signal, the first terminal of the compensation sub-circuit 200 may be electrically unlinked from the second terminal of the compensation sub-circuit 200, and the third terminal of the compensation sub-circuit 200 may be electrically unlinked from the fourth terminal of the compensation sub-circuit 200.

A second terminal of the data voltage storage sub-circuit 500 is electrically coupled to the high voltage input terminal DD. The data writing sub-circuit 300 includes a first terminal, a second terminal, and a control terminal. The first terminal of the data voltage storage sub-circuit 500 is further electrically coupled to a second terminal of the data writing sub-circuit 300. The data voltage storage sub-circuit 500 may be configured to store a data voltage inputted through the data writing sub-circuit 300 at a data writing phase.

The light-emitting sub-circuit 400 may be configured to receive a driving current from the driving sub-circuit M1 and emit light under the driving of the driving current at a light emission phase.

A first terminal of the data writing sub-circuit 300 is electrically coupled to a data signal input terminal DATA. The second terminal of the data writing sub-circuit 300 is electrically coupled to the first terminal of the data voltage storage sub-circuit 500. In response to a data writing control signal received at a control terminal of the data writing sub-circuit 300, the first terminal of the data writing sub-circuit 300 may be electrically linked to the second terminal of the data writing sub-circuit 300.

Similarly, in the present disclosure, the type of the data writing control signal may be selected according to the type of a transistor in the data writing sub-circuit 300. If the transistor in the data writing sub-circuit 300 is a P-type transistor, the data writing control signal may be a low level signal. If the transistor in the data writing sub-circuit 300 is an N-type transistor, the data writing control signal may be a high level signal.

Because the data voltage storage sub-circuit 500 is provided in the pixel circuit of the disclosure, a data voltage may not be stored in the compensation sub-circuit.

In some embodiments, in an operation of the disclosed pixel circuit, each duty cycle may at least include three phases, i.e., a compensation phase, a data writing phase, and a light emission phase. As shown in FIG. 1, the control terminal of the compensation sub-circuit 200 is electrically coupled to a compensation control gate line G(N−1), and the control terminal of the data writing sub-circuit 300 is electrically coupled to a data writing control gate line G(N).

At the compensation phase, the threshold voltage Vth of the driving sub-circuit M1 is stored in the compensation sub-circuit 200. Further, at this phase, a voltage at the third terminal of the compensation sub-circuit 200 is a fixed voltage from the fixed voltage terminal, and no data voltage is inputted. Thus, at the compensation phase of each duty cycle, the voltage at the third terminal of the compensation sub-circuit 200 is a stable fixed voltage from the fixed voltage terminal FIX, without being affected by the data voltage. As a result, the driving sub-circuit M1 can be quickly and stably configured to function as a diode at the compensation phase, and the threshold voltage Vth of the driving sub-circuit M1 can be stored in the compensation sub-circuit 200 at the compensation phase for each duty cycle. Correspondingly, a voltage at the second terminal of the compensation sub-circuit 200, which is coupled to the gate electrode of the driving sub-circuit M1, may be (VDD+Vth).

At the data writing phase, data is written into the data voltage storage sub-circuit 500, the fourth terminal of the compensation sub-circuit 200 is unlinked from the third terminal of the compensation sub-circuit 200, and the first terminal of the compensation sub-circuit 200 is unlinked from the second terminal of the compensation sub-circuit 200. The data writing sub-circuit 300 and the compensation sub-circuit 200 are coupled in series. The compensation sub-circuit 200 can store electric energy, and the compensation sub-circuit 200 may include a capacitor or a device equivalent to a capacitor. Accordingly, at the data writing phase, the compensation sub-circuit 200 may generate a bootstrapping effect, such that the voltage at the second terminal of the compensation sub-circuit 200, which is coupled to the gate electrode of the driving sub-circuit M1, may be changed from (VDD+Vth) to (VDD+Vth)+(Vdata−V0). VDD is the high voltage signal inputted through the high voltage input terminal DD, Vdata is the data voltage at the data input terminal DATA, and V0 is the fixed voltage inputted from the fixed voltage terminal FIX.

At the light emission phase, the driving current of the light-emitting sub-circuit 400 can be calculated according to the following formula.

$$\begin{aligned} I &= K*(Vgs-Vth)^2 \qquad (1)\\ &= K*(V2-VDD-Vth)^2\\ &= K*(VDD+Vth+Vdata-V0-VDD-Vth)^2\\ &= K*(Vdata-V0)^2, \end{aligned}$$

where K is a constant related to a material and a size of the driving sub-circuit M1, V2 is the voltage at the second terminal of the compensation sub-circuit 200, and Vgs is a gate-source voltage of the driving sub-circuit M1.

Thus, the driving current of the light-emitting sub-circuit 400 may be related to only the data voltage and the fixed voltage, and may be independent of the threshold voltage of the driving sub-circuit M1. As a result, the process non-uniformity of a display panel may not influence the display brightness, the uniformity of the display brightness can be improved, and the image quality of the display device may be improved.

Figure 2:
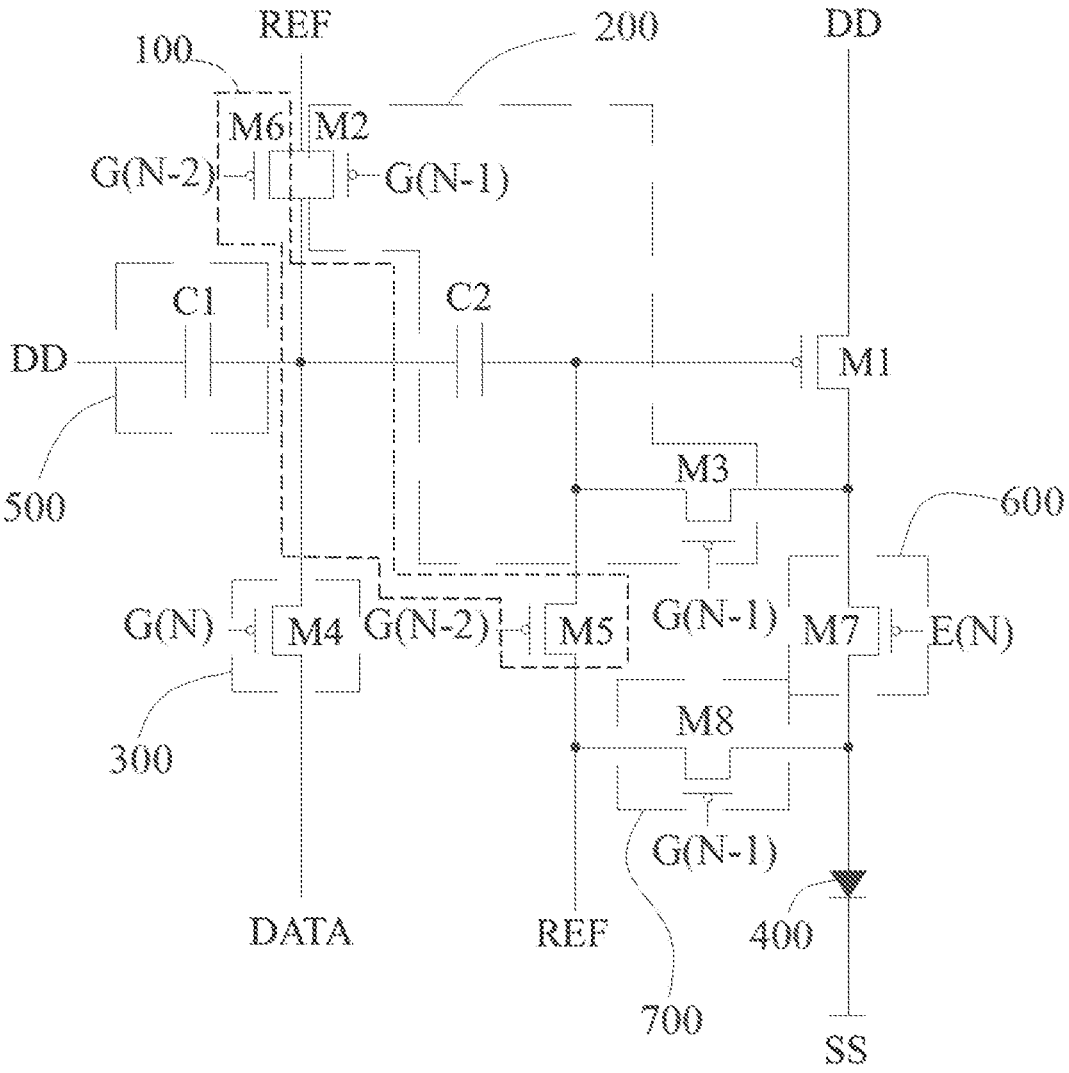
FIG. 2 illustrates a schematic view of an exemplary pixel circuit according to various disclosed embodiments of the present disclosure.

In the present disclosure, the fixed voltage V0 is not restricted, and may be selected according to various application scenarios. FIG. 2 illustrates a schematic view of an exemplary pixel circuit according to the various disclosed embodiments of the present disclosure. As shown in FIG. 2, the fixed voltage terminal is coupled to a reference voltage input terminal REF. Accordingly, the fixed voltage V0 is the reference voltage Vref inputted through the reference voltage input terminal REF. In this case, the driving current is independent of a magnitude of the voltage inputted from the high voltage input terminal. This can suppress a voltage drop caused by a wire resistance (R) through which a current (I) passes in the pixel circuit, i.e., an IR drop.

Figure 3:
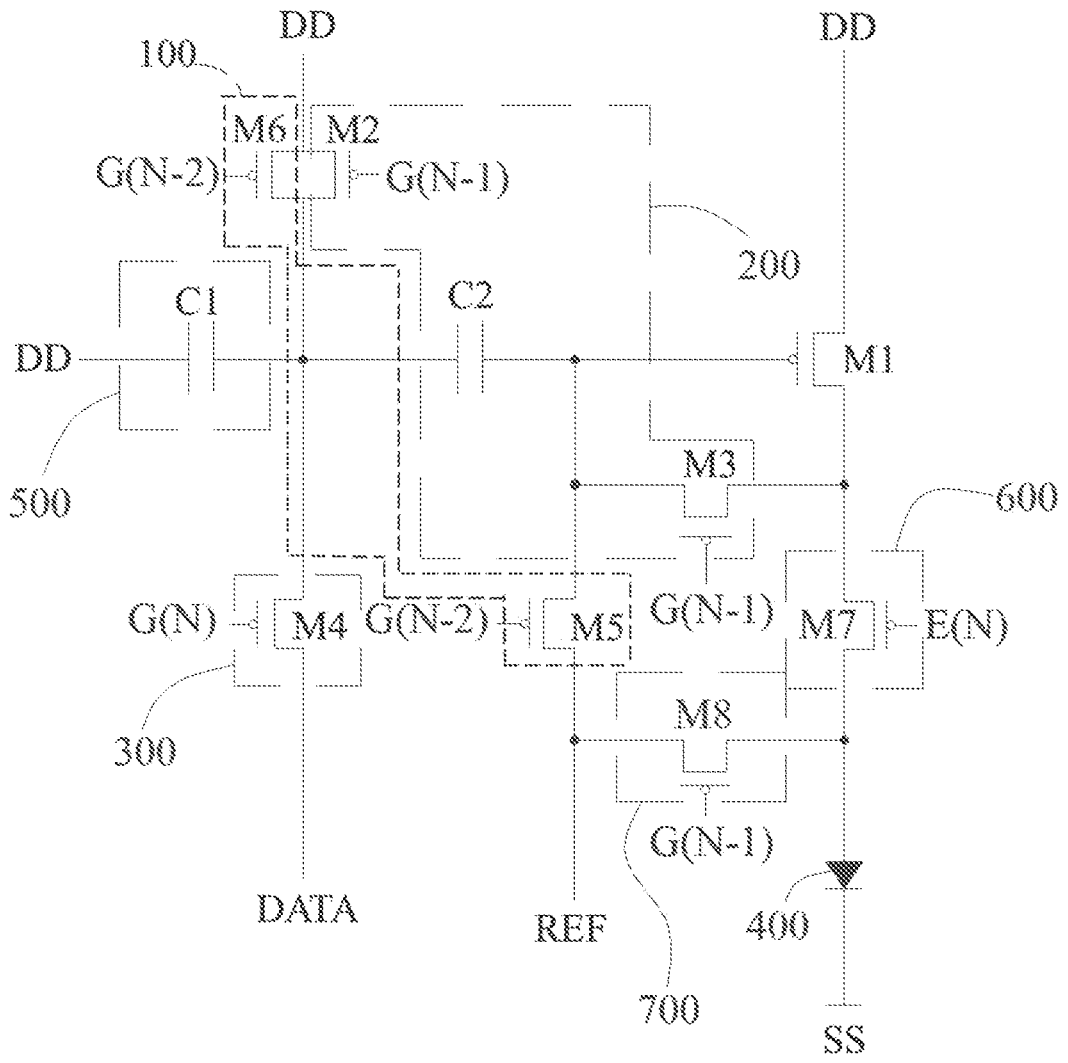
FIG. 3 illustrates a schematic view of another exemplary pixel circuit according to the various disclosed embodiments of the present disclosure.

FIG. 3 illustrates a schematic view of another exemplary pixel circuit according to various disclosed embodiments of the present disclosure. As shown in FIG. 3, the fixed voltage terminal is coupled to the high voltage input terminal DD. The fixed voltage V0 is the high voltage VDD inputted through the high voltage input terminal DD. Accordingly, the driving current may be independent of the threshold voltage of the driving sub-circuit M1.

In addition, during the operation of the pixel unit of the present disclosure, the compensation phase and the data writing phase may be performed at two different phases, and the threshold voltage of the driving sub-circuit M1 and the data voltage may be stored in the compensation sub-circuit 200 and the data voltage storage sub-circuit 500 separately. Thus, when the compensation sub-circuit 200 configures the driving sub-circuit M1 to function as a diode, the compensation sub-circuit 200 may not be influenced by different data voltages of different duty cycles, such that the driving sub-circuit M1 can be quickly and stably configured to function as a diode to ensure that the threshold voltage is written into the compensation sub-circuit. As a result, an influence of different threshold voltages caused by process non-uniformities on display images may be suppressed, and a display quality of the display panel including the pixel units can be improved.

For a better display, in some embodiments, the pixel circuit may further include the initialization sub-circuit 100. As shown in FIG. 1, a first terminal of the initialization sub-circuit 100 is electrically coupled to the fixed voltage terminal FIX. A second terminal of the initialization sub-circuit 100 is electrically coupled to the third terminal of the compensation sub-circuit 200. A third terminal of the initialization sub-circuit 100 is electrically coupled to the second terminal of the compensation sub-circuit 200. A fourth terminal of the initialization sub-circuit 100 is electrically coupled to the reference voltage input terminal REF. In response to an initialization control signal received at a control terminal of the initialization sub-circuit 100, the initialization sub-circuit 100 can electrically link the second terminal of the initialization sub-circuit 100 to the first terminal of the initialization sub-circuit 100, and electrically link the third terminal of the initialization sub-circuit 100 to the fourth terminal of the initialization sub-circuit 100.

Similarly, in the present disclosure, the type of the initialization control signal may be selected according to the type of a transistor in the initialization sub-circuit 100. If the transistor in the initialization sub-circuit 100 is a P-type transistor, the initialization control signal may be a low level signal. If the transistor in the initialization control sub-circuit 100 is an N-type transistor, the initialization control signal may be a high level signal.

Correspondingly, an initialization phase may be included in the duty cycle of the pixel circuit. At the initialization phase, the initialization control signal is provided to the control terminal of the initialization sub-circuit 100, such that the second terminal of the initialization sub-circuit 100 is electrically linked to the first terminal of the initialization sub-circuit 100, and the third terminal of the initialization sub-circuit 100 is electrically linked to the fourth terminal of the initialization sub-circuit 100. That is, the third terminal of the compensation sub-circuit 200 is electrically linked to the fixed voltage terminal FIX, and the second terminal of the compensation sub-circuit 200 is electrically linked to the reference voltage input terminal REF. Accordingly, residual charges at the gate electrode of the driving sub-circuit M1 can be discharged, and the voltage at the third terminal of the compensation sub-circuit 200 can be stable.

In the present disclosure, the structure of the data voltage storage sub-circuit 500 is not restricted, and may be selected according various application scenarios. In some embodiments, as shown in FIG. 2 and FIG. 3, the data voltage storage sub-circuit 500 includes a data voltage storage capacitor C1. A first electrode plate of the data voltage storage capacitor C1 serves as the second terminal of the data voltage storage sub-circuit 500. That is, the first electrode plate of the data voltage storage capacitor C1 is electrically coupled to the high voltage input terminal DD. A second electrode plate of the data voltage storage capacitor C1 serves as the first terminal of the data voltage storage sub-circuit 500. That is, the second electrode plate of the data voltage storage capacitor C1 is electrically coupled to the third terminal of the compensation sub-circuit 200.

At the compensation phase, a voltage at the second electrode plate of the data voltage storage capacitor C1 is the fixed voltage V0 from the fixed voltage terminal FIX, which can be the reference voltage Vref from the reference voltage input terminal REF in the example shown in FIG. 2 or the high voltage VDD from the high voltage input terminal DD in the example shown in FIG. 3. A voltage at the third terminal of the compensation sub-circuit 200 is the fixed voltage V0 from the initialization sub-circuit 100.

At the data writing phase, the data voltage inputted through the data writing sub-circuit 300 is stored in the data voltage storage capacitor C1.

In the present disclosure, the structure of the compensation sub-circuit 200 is not restricted. In some embodiments, as shown in FIG. 2, the compensation sub-circuit 200 includes a compensation capacitor C2, a first compensation transistor M2, and a second compensation transistor M3.

As shown in FIG. 2, a first electrode plate of the compensation capacitor C2 serves as the third terminal of the compensation sub-circuit 200, and a second electrode plate of the compensation capacitor C2 serves as the second terminal of the compensation sub-circuit 200.

A first electrode of the first compensation transistor M2 serves as the fourth terminal of the compensation sub-circuit 200. That is, the first electrode of the first compensation transistor M2 is electrically coupled to the fixed voltage terminal. In FIG. 2, the fixed voltage terminal is coupled to the reference voltage input terminal REF. In FIG. 3, the fixed voltage terminal is coupled to the high voltage input terminal DD. A second electrode of the first compensation transistor M2 is electrically coupled to the first electrode plate of the compensation capacitor C2. A gate electrode of the first compensation transistor M2 serves as the control terminal of the compensation sub-circuit 200.

A first electrode of the second compensation transistor M3 serve as the second terminal of the compensation sub-circuit 200. That is, the first electrode of the second compensation transistor M3 is electrically coupled to the gate electrode of the driving sub-circuit M1, and is electrically coupled to the second electrode plate of the compensation capacitor C2. A second electrode of the second compensation transistor M3 serves as the first terminal of the compensation sub-circuit 200. That is, the second electrode of the second compensation transistor M3 is electrically coupled to the second electrode of the drive transistor M1.

The gate electrode of the first compensation transistor M2 is electrically coupled to a gate electrode of the second compensation transistor M3.

The first compensation transistor M2 may have a same type as the second compensation transistor M1 in some embodiments, the first compensation transistor M2 and the second compensation transistor M3 may both be N-type transistors. In some other embodiments, the first compensation transistor M2 and the second compensation transistor M3 may both be P-type transistors. In certain embodiments, as shown in FIG. 2 and FIG. 3, the first compensation transistor M2 and the second compensation transistor M3 are both P-type transistors, gate electrodes of the first compensation transistor M2 and the second compensation transistor M3 are both electrically coupled to the compensation control gate line G(N−1), and the first compensation transistor M2 and the second compensation transistor M1 may be turned on in response to a low-level signal received at the gate electrodes.

At the compensation phase, the gate electrode of the first compensation transistor M2 and the gate electrode of the second compensation transistor M3 receive the compensation control signal and are turned on. As a result, the fixed voltage from the fixed voltage terminal is provided to the first electrode plate of the compensation capacitor C2. Further, the gate electrode of the driving sub-circuit M1 is electrically coupled to the second electrode of the driving sub-circuit M1 such that the driving sub-circuit M1 functions as a diode.

Similarly, in the present disclosure, the structure of the data writing sub-circuit 300 is not restricted. In some embodiments, as shown in FIG. 2 and FIG. 3, the data writing sub-circuit 300 includes a data writing transistor M4. A first electrode of the data writing transistor M4 is electrically coupled to the data signal input terminal DATA, and serves as the first terminal of the data writing sub-circuit 300. A second electrode of the data writing transistor M4 serves as the second terminal of the data writing sub-circuit 300. A gate electrode of the data writing transistor M4 serves as the control terminal of the data writing sub-circuit 300.

At the data writing phase, a data writing control signal is provided to the gate electrode of the data writing transistor M4. Thus, the first electrode and the second electrode of the data writing transistor M4 are electrically linked. Accordingly, A signal inputted through the data signal input terminal DATA is stored in the data voltage storage capacitor C1. Further, the data voltage storage capacitor C1 and the compensation capacitor C2 of the compensation sub-circuit 200 are coupled in series.

At the light emission phase, the driving current obtained according to Equation (1) causes the light-emitting sub-circuit 400 to emit light.

In the present disclosure, the structure of the initialization sub-circuit 100 is not restricted. In some embodiments, as shown in FIG. 2 and FIG. 3, the initialization sub-circuit 100 includes a first initialization transistor M5 and a second initialization transistor M6.

A first electrode of the first initialization transistor M5 serves as the fourth terminal of the initialization sub-circuit 100. That is, the first electrode of the first initialization transistor M5 is electrically coupled to the reference voltage input terminal REF. A second electrode of the first initialization transistor M5 is electrically coupled to the second terminal of the compensation sub-circuit 200. A gate electrode of the first initialization transistor M5 serves as the control terminal of the initialization sub-circuit 100.

A first electrode of the second initialization transistor M6 serves as the first terminal of the initialization sub-circuit 100. That is, the first electrode of the second initialization transistor M6 is electrically coupled to the fixed voltage terminal. In some embodiments, as shown in FIG. 2, the fixed voltage terminal includes the reference voltage input terminal REF. In some other embodiments, as shown in FIG. 3, the fixed voltage terminal includes the high voltage input terminal DD. A second electrode of the second initialization transistor M6 serves as the second terminal of the initialization sub-circuit 100. That is, the second electrode of the second initialization transistor M6 is electrically coupled to the third terminal of the compensation sub-circuit 200. A gate electrode of the second initialization transistor M6 is electrically coupled to the gate electrode of the first initialization transistor M5. In some embodiments, as shown in FIG. 2, the gate electrode of the second initialization transistor M6 and the gate electrode of the first initialization transistor M5 are both electrically coupled to the initialization control gate line G(N−2).

The first initialization transistor M5 may have a same type as the second initialization transistor M6. In some embodiments, the first initialization transistor M5 and the second initialization transistor M6 may both be N-type transistors. In some other embodiments, the first initialization transistor M5 and the second initialization transistor M6 may both be P-type transistors. In certain embodiments, as shown in FIG. 2 and FIG. 3, the first initialization transistor M5 and the second initialization transistor M6 are both P-type transistors.

At the initialization phase, an initialization control signal is provided to the gate electrode of the first initialization transistor M5 and the gate electrode of the second initialization transistor M6, and the first initialization transistor M5 and the second initialization transistor M6 are turned on.

For energy saving and better display, in some embodiments, the light-emitting sub-circuit 400 may emit light only at the light emission phase, and may not emit light at other phases.

Further, the pixel circuit includes a light emission control sub-circuit 600 coupled between the driving sub-circuit M1 and the light-emitting sub-circuit 400. A first terminal of the light emission control sub-circuit 600 is electrically coupled to the second electrode of the driving sub-circuit M1. A second terminal of the light emission control sub-circuit 600 is electrically coupled to a first terminal of the light-emitting sub-circuit 400. In response to a light emission control signal received at a control terminal of the light emission control sub-circuit 600, the light emission control sub-circuit 600 electrically link the second electrode of the driving sub-circuit M1 to the first terminal of the light-emitting sub-circuit 400.

The light emission control signal may be provided to the control terminal of the light emission control sub-circuit 600 only at the light emission phase. Thus, the driving current may flow through the light-emitting sub-circuit 400 only at the light emission phase.

Similarly, in the present disclosure, the type of the light emission control signal may be selected according to the type of the transistor in the light emission control sub-circuit 600. If the transistor in the light emission control sub-circuit 600 is a P-type transistor, the light emission control signal may be a low level signal. If the transistor in the light emission control sub-circuit 600 is an N-type transistor, the light emission control signal may be a high level signal.

In the present disclosure, the structure of the light emission control sub-circuit 600 is not restricted. In some embodiments, as shown in FIG. 2 and FIG. 3, the light emission control sub-circuit includes a light emission control transistor M7. A first electrode of the light emission control transistor M7 serves as the first terminal of the light emission control sub-circuit 600. That is, the first electrode of the light emission control transistor M7 is electrically coupled to the second electrode of the driving sub-circuit M1. A second electrode of the light emission control transistor M7 serves as the second terminal of the light emission control sub-circuit 600. That is, the second electrode of the light emission control transistor M7 is electrically coupled to the first terminal of the light-emitting sub-circuit 400. A gate electrode of the light emission control transistor M7 serves as the control terminal of the light emission control sub-circuit 600.

At the light emission phase, a light emission control signal is provided to the gate electrode of the light emission control transistor M7, and the light emission control transistor M7 is turned on, such that the second electrode of the driving sub-circuit M1 is electrically linked to the light-emitting sub-circuit 400.

For a better dark-state display, in some embodiments, the pixel circuit further includes a discharge sub-circuit 700. A first terminal of the discharge sub-circuit 700 is electrically coupled to the reference voltage input terminal REF. A second terminal of the discharge sub-circuit 700 is electrically coupled to the first terminal of the light-emitting sub-circuit 400. The discharge sub-circuit 700 can electrically link the first terminal and the second terminal of the discharge sub-circuit 700, in response to a discharge control signal received at a control terminal of the discharge sub-circuit 700.

Similarly, in the present disclosure, the type of the discharge control signal may be selected according to the type of the transistor in the discharge sub-circuit 700. If the transistor in the discharge sub-circuit 700 is a P-type transistor, the discharge control signal may be a low level signal. If the transistor in the discharge sub-circuit 700 is an N-type transistor, the discharge control signal may be a high level signal.

Generally, the light-emitting sub-circuit 400 in the pixel circuit may include a light-emitting diode. The light-emitting diode may have a layered structure, resulting in a parasitic capacitance. After the first and second terminals of the discharge sub-circuit 700 are electrically linked, the first terminal of the light-emitting sub-circuit 400 may be electrically linked to the reference voltage input terminal REF, such that residual charges at the first terminal of the light-emitting sub-circuit 400 can be discharged, facilitating the dark-state display.

The control terminal of the discharge sub-circuit 700 can be electrically coupled to the control terminal of the compensation sub-circuit 200 to complete the discharge at the compensation phase.

In some embodiments, as shown in FIG. 2 and FIG. 3, the discharge sub-circuit 700 includes a discharge transistor M8. A first electrode of the discharge transistor M5 serves as the first terminal of the discharge sub-circuit 700. That is, the first electrode of the discharge transistor M8 is electrically coupled to the reference voltage input terminal REF. A second electrode of the discharge transistor M8 serves as the second terminal of the discharge sub-circuit 700. That is, the second electrode of the discharge transistor M8 is electrically coupled to the first terminal of the light-emitting sub-circuit 400. A gate electrode of the discharge transistor M8 serves as the control terminal of the discharge sub-circuit 700.

At a compensation phase, a discharge control signal is provided to the gate electrode of the discharge transistor M8. The discharge transistor M8 is turned on, such that the first terminal of the light-emitting sub-circuit 400 is electrically linked to the reference voltage input terminal REF to discharge the first terminal of the light-emitting sub-circuit 400.

Figure 4:
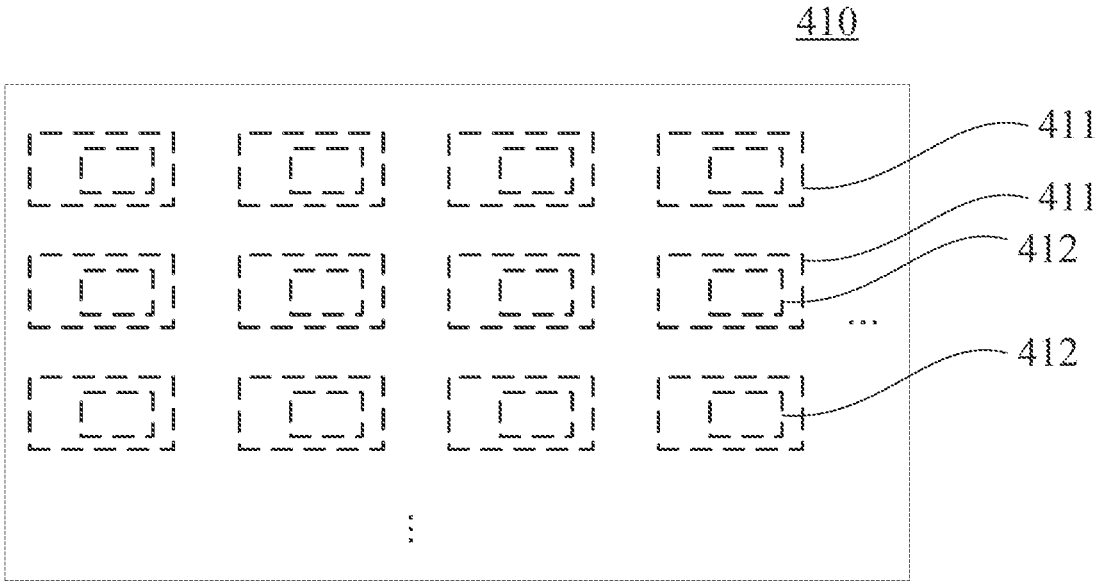
FIG. 4 illustrates a schematic view of an exemplary display panel according to various disclosed embodiments of the present disclosure.

The present disclosure further provides a display panel. FIG. 4 illustrates a schematic view of an exemplary display panel 410 according to various disclosed embodiments of the present disclosure. As shown in FIG. 4, the display panel 410 includes a plurality of pixel units 411. Each pixel unit is provided with a pixel circuit 412. The pixel circuit 412 can be any one of the pixel circuits according to the present disclosure, such as one of the exemplary pixel circuits described above. The display panel 410 may form a display device, alone or together with one or more other appropriate structures. The display device including the display panel may be an electronic paper, an OLED panel, a mobile phone, a tablet computer, a television, a monitor, a notebook computer, a digital photo frame, a navigator, or any suitable product or component having a display function.

The display panel may include data lines and a plurality of sets of gate lines, i.e., plurality of gate line sets. A data line may be electrically coupled to the data signal input terminal.

Each gate line set may include a compensation control gate line G(N−1), a data writing control gate line G(N), and an initialization control gate line G(N−2). As shown in FIG. 1, the compensation control gate line G(N−1) is electrically coupled to the control terminal of the compensation sub-circuit 200. The data writing control gate line G(N) is electrically coupled to the control terminal of the data writing sub-circuit 300. The initialization control gate line G(N−2) is electrically coupled to the control terminal of the initialization sub-circuit 100.

Figure 5:
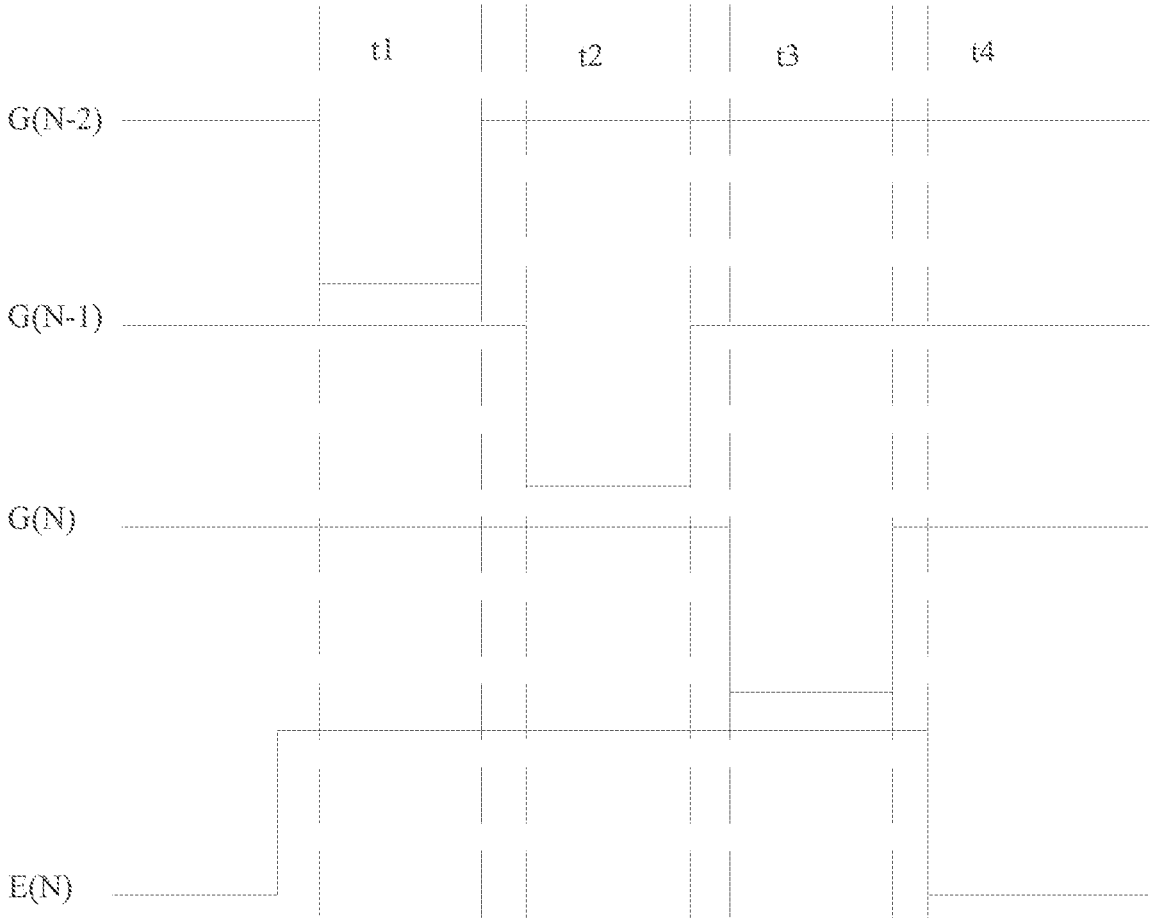
FIG. 5 illustrates schematic views of exemplary sequence signals for different gate lines according to various disclosed embodiments of the present disclosure.

FIG. 5 illustrates scheme views of exemplary sequence signals in one duty cycle for different gate lines in a gate line set according to various disclosed embodiments of the present disclosure. In FIG. 5, a duty cycle including an initialization phase t1, a compensation phase t2, a data writing phase t3, and a light emission phase t4 is shown.

As shown in FIG. 5, at the compensation phase t2, a compensation control signal is provided to the compensation control gate line G(N−1). At the data writing phase t3, a data writing control signal is provided to the data writing control gate line G(N).

As described above, in some embodiments, the pixel circuit further includes the light emission control sub-circuit 600. Accordingly, each gate line set may further include a light emission control gate line E(N). The control terminal of the light emission control sub-circuit may be electrically coupled to the light emission control gate line E(N). As shown in FIG. 5, at the light emission phase t4, a light emission control signal is provided to the light emission control gate line E(N).

In some embodiments, the pixel circuit may also include an initialization sub-circuit 100. In these embodiments, each gate line set may further include an initialization control gate line G(N−2). As shown in FIG. 5, at the initialization phase t1, an initialization control signal is provided to the initialization control gate line G(N−2).

Figure 6:
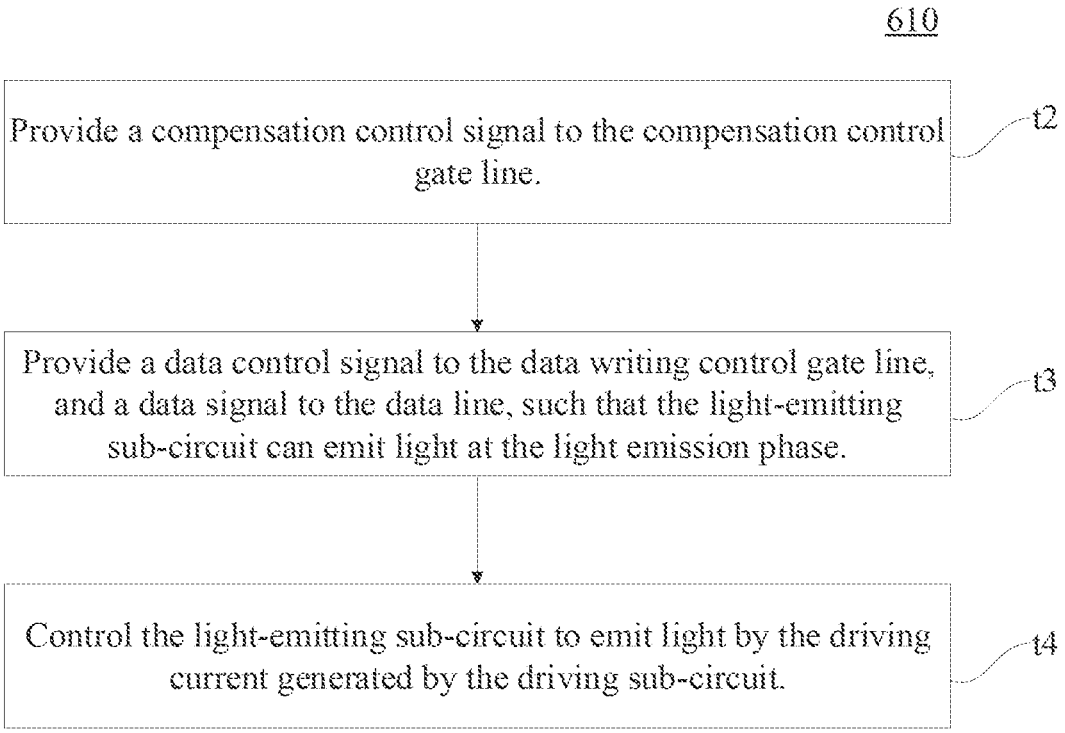
FIG. 6 illustrates a schematic view of an exemplary driving method for an exemplary display panel according to various disclosed embodiments of the present disclosure.

The present disclosure further provides a driving method for a display panel. FIG. 6 illustrates a schematic view of an exemplary driving method 610 for an exemplary display panel according to various disclosed embodiments of the present disclosure. The display panel is a display panel provided by the present disclosure. The driving method may have a plurality of duty cycles. Each duty cycle may include a plurality of phases. The plurality of phases may include a compensation phase, a data writing phase, and a light emission phase. The driving method 610 will now be described.

At the compensation phase t2, a compensation control signal is provided to the compensation control gate line.

At the data writing phase t3, a data control signal is provided to the data writing control gate line, and a data signal is provided to the data line, such that the light-emitting sub-circuit can emit light at the light emission phase.

At the light emission phase t4, the light-emitting sub-circuit is controlled to emit light by the driving current generated by the driving sub-circuit.

In some embodiments, the pixel circuit may further include the light emission control sub-circuit. Correspondingly, at the light emission phase t4, a light emission control signal is provided to the light emission control gate line E(N).

The pixel circuit may further include the initialization sub-circuit 100. Correspondingly, the plurality of phases may further include the initialization phase t1. At the initialization phase t1, an initialization control signal is provided to the initialization control gate line G(N−2).

In order to ensure that the transistors that are turned on at a prior phase are turned off before beginning of a current phase, in some embodiments, in the plurality of phases of a duty cycle, at least one phase may be provided with a time interval between the at least one phase and a phase adjacent to the at least one phase.

As shown in FIG. 5, a time interval exists between the initialization phase t1 and the compensation phase t2, a time interval exists between the compensation phase t2 and the data writing phase t3, and a time interval exists between the data writing phase t3 and the light emission phase t4.

The driving method of the present disclosure will be described in detail with reference to FIGS. 2, 5, and 6.

In some embodiments, as shown in FIG. 2, the pixel circuit includes the initialization sub-circuit 100, the compensation sub-circuit 200, the data writing sub-circuit 300, the data voltage storage sub-circuit 500, the discharge sub-circuit 700, the light emission control sub-circuit 600, and the light-emitting sub-circuit 400. Each gate line set of the display panel may include the initialization control gate line G(N−2), the compensation control gate line G(N−1), the data writing control gate line G(N), and the light emission control gate line E(N).

The initialization sub-circuit 100 includes the first initialization transistor M5 and the second initialization transistor M6. The first initialization transistor M5 and the second initialization transistor M6 are both P-type transistors. Correspondingly, the initialization control signal is a low level signal. The compensation sub-circuit 200 includes the compensation capacitor C2, the first compensation transistor M2, and the second compensation transistor M3. The first compensation transistor M2 and the second compensation transistor M3 are both P-type transistors. Correspondingly, the compensation control signal is a low level signal. The data voltage storage sub-circuit 500 includes the data voltage storage capacitor C1. The data writing sub-circuit 300 includes the data writing transistor M4. The data writing transistor M4 is a P-type transistor. Correspondingly, the data writing control signal is a low level signal. The light emission control sub-circuit 600 includes the light emission control transistor M7. The light emission control transistor M7 is a P-type transistor. Correspondingly, the light emission control signal is a low level signal. The discharge sub-circuit 700 includes the discharge transistor M8. The discharge transistor M8 is a P-type transistor. Correspondingly, the discharge control signal is a low level signal.

The gate electrode of the first initialization transistor M5 and the gate electrode of the second initialization transistor M6 are electrically coupled to the initialization control gate line G(N−2). The first electrode of the first transistor M5 is electrically coupled to the reference voltage input terminal REF. The second electrode of the first initialization transistor M5 is electrically coupled to the second electrode plate of the compensation capacitor C2. The first electrode of the second initialization transistor M6 is electrically coupled to the reference voltage input terminal REF. The second electrode of the second initialization transistor M6 is electrically coupled to the first electrode plate of the compensation capacitor C2.

The gate electrode of the first compensation transistor M2 is electrically coupled to the gate electrode of the second compensation transistor M3, and electrically coupled to the gate electrode of the discharge transistor M8. The gate electrode of the first compensation transistor M2, the gate electrode of the second compensation transistor M3, and the gate electrode of the discharge transistor M8 are electrically coupled to the compensation control gate line G(N−1). As shown in FIG. 2, the first electrode of the first compensation transistor M2 is electrically coupled to the reference voltage input terminal REF. The second electrode of the first compensation transistor M2 is electrically coupled to the first electrode plate of the compensation capacitor C2. The first electrode of the second compensation transistor M3 is electrically coupled to the first electrode plate of the compensation capacitor C2. The second electrode of the second compensation transistor M3 is electrically coupled to the second electrode of the driving sub-circuit M1. The first electrode of the discharge transistor M8 is electrically coupled to the reference voltage input terminal REF. The second electrode of the discharge transistor M8 is electrically coupled to the first terminal of the light-emitting sub circuit 400.

The first electrode of the data writing transistor M4 is electrically coupled to the data signal input terminal DATA. The second electrode of the data writing transistor M4 is electrically coupled to the first electrode plate of the compensation capacitor C2. The gate electrode of the data writing transistor M4 is electrically coupled to the data writing control gate line G(N).

The gate electrode of the light emission control transistor M7 is electrically coupled to the light emission control gate line E(N). The first electrode of the light emission control transistor M7 is electrically coupled to the second electrode of the driving sub-circuit M1. The second electrode of the light emission control transistor M7 is electrically coupled to the first terminal of the light-emitting sub-circuit 400.

In the pixel circuit, the light-emitting sub-circuit 400 may be a light-emitting diode, and a second terminal of the light-emitting sub-circuit may be electrically coupled to a low voltage signal input terminal SS. A high level signal may be provided through the high voltage signal input terminal DD. A low level signal may be provided through a low voltage signal input terminal SS.

At the initialization phase t1, a low level initialization control signal is provided to the initialization control gate line G(N−2), the first initialization transistor M5 and the second initialization transistor M6 are turned on, and the other transistors are turned off. Further, and a reference voltage inputted from the reference voltage input terminal REF is transmitted to the first and second electrode plates of the compensation capacitor C2, such that the compensation capacitor C2 and the gate electrode of the driving sub-circuit M1 are initialized.

At the compensation phase t2, a low level compensation control signal is provided to the compensation control gate line G(N−1), the first compensation transistor M2 and the second compensation transistor M3 are turned on, and the first compensation transistor M2 holds a voltage at the first electrode plate of the compensation capacitor C2 at the reference voltage. Thus, the driving sub-circuit M1 can be quickly and stably configured to function as a diode, and the threshold voltage Vth of the driving sub-circuit M1 can be written into the compensation capacitor C2. At the compensation phase t2, the discharge transistor M8 is turned on, and the first terminal of the light-emitting sub-circuit 400 is electrically linked to the reference voltage input terminal REF, such that the first terminal of the light-emitting sub-circuit 400 is discharged.

At the data writing phase t3, a low level data writing control signal is provided to the data writing control gate line G(N), the data writing transistor M4 is turned on, and the data signal from the data line is transmitted from the data signal input terminal DATA to the data voltage storage capacitor C1.

At the light emission phase t4, a low level light emission control signal is provided to the light emission control gate line E(N), and the light emission control transistor M7 is turned on, such that the driving current generated by the driving sub-circuit M1 causes the light-emitting sub-circuit 400 to emit light.

The present disclosure provides a pixel circuit, a display panel, and a method of driving the display panel. The pixel circuit may include a driving sub-circuit, a compensation sub-circuit, a data writing sub-circuit, a light-emitting sub-circuit, and a data voltage storage sub-circuit. In response to a compensation control signal received at a control terminal of the compensation sub-circuit, a first terminal of the compensation sub-circuit may be electrically linked to a second terminal of the compensation sub-circuit, such that a second electrode of the driving sub-circuit and a gate electrode of the driving sub-circuit may be electrically linked, and a threshold voltage of the driving sub-circuit may be stored in the compensation sub-circuit. Further, in response to the compensation control signal received at the control terminal of the compensation sub-circuit, the fourth terminal of the compensation sub-circuit may be electrically linked to the third terminal of the compensation sub-circuit. The data voltage storage sub-circuit may be configured to store a data voltage inputted through the data writing sub-circuit, at a data writing phase. The light-emitting sub-circuit may be configured to emit light under the driving of a driving current. The pixel circuit can quickly form a diode coupling at the compensation phase, and can suppress the influence of process non-uniformities on the light emission of the display panel.

The foregoing description of the embodiments of the disclosure has been presented fin purposes of illustration and description. It is not intended to be exhaustive or to limit the disclosure to the precise form or to exemplary embodiments disclosed. Accordingly, the foregoing description should be regarded as illustrative rather than restrictive. Obviously, many modifications and variations will be apparent to persons skilled in this art. The embodiments are chosen and described in order to explain the principles of the technology, with various modifications suitable to the particular use or implementation contemplated. It is intended that the scope of the invention be defined by the claims appended hereto in which all terms are meant in their broadest reasonable sense unless otherwise indicated. Therefore, the term "the disclosure," "the present disclosure," or the like does not limit the claim scope to a specific embodiment, and the reference to exemplary embodiments of the disclosure does not imply a limitation on the invention, and no such limitation is to be inferred. Moreover, the claims may refer to "first," "second," etc., followed by a noun or element. Such terms should be understood as a nomenclature and should not be construed as giving the limitation on the number of the elements modified by such nomenclature unless specific number has been given. Any advantages and benefits described may or may not apply to all embodiments of the disclosure. It should be appreciated that variations may be made to the embodiments described by persons skilled in the art without departing from the scope of the present disclosure. Moreover, no element or component in the present disclosure is intended to be dedicated to the public regardless of whether the element or component is explicitly recited in the following claims.

What is claimed is:

1. A pixel circuit, comprising:

a driving sub-circuit including a first electrode electrically coupled to a high voltage input terminal and a second electrode configured to output a driving current;

a compensation sub-circuit including:

a first terminal electrically coupled to the second electrode of the driving sub-circuit;

a second terminal electrically coupled to a gate electrode of the driving sub-circuit;

a third terminal;

a fourth terminal electrically coupled to a fixed voltage terminal; and a control terminal, the compensation sub-circuit being configured to:

store a threshold voltage of the driving sub-circuit, and in response to a compensation control signal received at the control terminal, electrically link the fourth terminal of the compensation sub-circuit to the third terminal of the compensation sub-circuit and electrically link the first terminal of the compensation sub-circuit to the second terminal of the compensation sub-circuit;

a data writing sub-circuit including a first terminal, a second terminal, and a control terminal, the data writing sub-circuit being configured to:

in response to a data writing control signal received at the control terminal of the data writing sub-circuit, electrically link the first terminal of the data writing sub-circuit to the second terminal of the data writing sub-circuit;

a data voltage storage sub-circuit configured to store a data voltage inputted through the data writing sub-circuit, the data voltage storage sub-circuit including:

a first terminal electrically coupled to the third terminal of the compensation sub-circuit and the second terminal of the data writing sub-circuit; and a second terminal electrically coupled to the high voltage input terminal; and an initialization sub-circuit including a first terminal electrically coupled to the fixed voltage terminal, a second terminal electrically coupled to the third terminal of the compensation sub-circuit, a third terminal electrically coupled to the second terminal of the compensation sub-circuit, a fourth terminal electrically coupled to a reference voltage input terminal, and a control terminal, wherein the initialization sub-circuit is configured to, in response to an initialization control signal received at the control terminal of the initialization sub-circuit, electrically link the second terminal of the initialization sub-circuit to the first terminal of the initialization sub-circuit and electrically link the third terminal of the initialization sub-circuit to the fourth terminal of the initialization sub-circuit.

2. The pixel circuit according to claim 1, wherein:

the data voltage storage sub-circuit includes a data voltage storage capacitor, the second terminal of the data voltage storage sub-circuit includes a first electrode plate of the data voltage storage capacitor, and the first terminal of the data voltage storage sub-circuit includes a second electrode of the data voltage storage capacitor.

3. The pixel circuit according to claim 1, wherein the compensation sub-circuit includes:

a compensation capacitor including a first electrode plate and a second electrode plate;

a first compensation transistor including a first electrode, a second electrode electrically coupled to the first electrode plate of the compensation capacitor, and a gate electrode; and a second compensation transistor including a first electrode, a second electrode, and a gate electrode electrically coupled to the gate electrode of the first compensation transistor, wherein:

the first terminal of the compensation sub-circuit includes the second electrode of the second compensation transistor, the second terminal of the compensation sub-circuit includes the second electrode plate of the compensation capacitor and the first electrode of the second compensation transistor, the third terminal of the compensation sub-circuit includes the first electrode plate of the compensation capacitor, the fourth terminal of the compensation sub-circuit includes the first electrode of the first compensation transistor, and the control terminal of the compensation sub-circuit includes the gate electrode of the first compensation transistor.

4. The pixel circuit according to claim 1, wherein:

the data writing sub-circuit includes a data writing transistor, the first terminal of the data writing sub-circuit includes a first electrode of the data writing transistor electrically coupled to a data signal input terminal, the second terminal of the data writing sub-circuit includes a second electrode of the data writing transistor, and the control terminal of the data writing sub-circuit includes a gate electrode of the data writing transistor.

5. The pixel circuit according to claim 1, further comprising:

a light-emitting sub-circuit coupled to the second electrode of the driving sub-circuit and configured to emit light in response to the driving current.

6. The pixel circuit according to claim 5, further comprising:

a light emission control sub-circuit including a first terminal electrically coupled to the second electrode of the driving sub-circuit, a second terminal electrically coupled to a first terminal of the light-emitting sub-circuit, and a control terminal, wherein the light emission control sub-circuit is configured to, in response to a light emission control signal received at the control terminal of the light emission control sub-circuit, electrically link the second electrode of the driving sub-circuit to the first terminal of the light-emitting sub-circuit.

7. The pixel circuit according to claim 6, wherein:

the light emission control sub-circuit includes a light emission control transistor, the first terminal of the light emission control sub-circuit includes a first electrode of the light emission control transistor, the second terminal of the light emission control sub-circuit includes a second electrode of the light emission control transistor, and the control terminal of the light emission control sub-circuit includes a gate electrode of the light emission control transistor.

8. The pixel circuit according to claim 5, further comprising:

a discharge sub-circuit including a first terminal electrically coupled to a reference voltage input terminal, a second terminal electrically coupled to a first terminal of the light-emitting sub-circuit, and a control terminal, wherein:

the discharge sub-circuit is configured to, in response to a discharge control signal received at the control terminal of the discharge sub-circuit, electrically link the first terminal of the discharge sub-circuit to the second terminal of the discharge sub-circuit, and the control terminal of the discharge sub-circuit is electrically coupled to the control terminal of the compensation sub-circuit.

9. The pixel circuit according to claim 8, wherein:

the discharge sub-circuit includes a discharge transistor, the first terminal of the discharge sub-circuit includes a first electrode of the discharge transistor, the second terminal of the discharge sub-circuit includes a second electrode of the discharge transistor, and the control terminal of the discharge sub-circuit includes a gate electrode of the discharge transistor.

10. The pixel circuit according to claim 1, wherein:

the initialization sub-circuit includes a first initialization transistor and a second initialization transistor, the fourth terminal of the initialization sub-circuit includes a first electrode of the first initialization transistor, the third terminal of the initialization sub-circuit includes a second electrode of the first initialization transistor, the control terminal of the initialization sub-circuit includes a gate electrode of the first initialization transistor, the first terminal of the initialization sub-circuit includes a first electrode of the second initialization transistor, the second terminal of the initialization sub-circuit includes a second electrode of the second initialization transistor, and a gate electrode of the second initialization transistor is electrically coupled to the gate electrode of the first initialization transistor.

11. The pixel circuit according to claim 1, wherein the fixed voltage terminal includes a reference voltage input terminal.

12. The pixel circuit according to claim 1, wherein the fixed voltage terminal includes the high voltage input terminal.

13. A display panel, comprising:

a plurality of pixel units each including a pixel circuit according to claim 1;

a plurality of data lines electrically coupled to data signal input terminals; and a plurality of sets of gate lines, wherein each one of the sets of gate lines is coupled to the pixel circuit of one of the pixel units and includes:

a compensation control gate line electrically coupled to the control terminal of the compensation sub-circuit of the pixel circuit;

a data writing control gate line electrically coupled to the control terminal of the data writing sub-circuit of the pixel circuit; and an initialization control gate line electrically coupled to a control terminal of an initialization sub-circuit of the pixel circuit.

14. The display panel according to claim 13, wherein:

each one of the sets of gate lines further include a light emission control gate line electrically coupled to a control terminal of a light emission control sub-circuit of the pixel circuit.

15. A driving method for a display panel according to claim 13, comprising:

at a compensation phase of a duty cycle, providing a compensation control signal to the compensation control gate line;

at a data writing phase of the duty cycle, providing a data writing control signal to the data writing control gate line and providing a data signal to the data line; and at a light emission phase, controlling a light-emitting sub-circuit of the pixel circuit to emit light by the driving current generated by the driving sub-circuit.

16. The driving method according to claim 15, wherein:

the pixel circuit includes a light emission control sub-circuit, each one of the sets of gate lines includes a light emission control gate line, and a control terminal of the light emission control sub-circuit is electrically coupled to the light emission control gate line, the driving method further comprising:

at the light emission phase, providing a light emission control signal to the light emission control gate line.

17. The driving method according to claim 15, further comprising:

at an initialization phase of the duty cycle before the compensation phase, providing an initialization control signal to an initialization control gate line.

18. The driving method according to claim 15, wherein a time interval is provided between at least two neighboring ones of the compensation phase, the data writing phase, and the light emission phase.

* * * * *